US009289035B2

(12) United States Patent
Kim

(10) Patent No.: US 9,289,035 B2
(45) Date of Patent: Mar. 22, 2016

(54) SELF-ADJUSTABLE JEWELRY CLASP

(71) Applicant: OORI Trading, Inc., Northvale, NJ (US)

(72) Inventor: Gwi Yon Kim, Hackensack, NJ (US)

(73) Assignee: OORI Trading, Inc., Northvale, NJ (US)

( * ) Notice: Subject to any disclaimer, the term of this patent is extended or adjusted under 35 U.S.C. 154(b) by 242 days.

(21) Appl. No.: 13/957,640

(22) Filed: Aug. 2, 2013

(65) Prior Publication Data

US 2015/0033795 A1 Feb. 5, 2015

(51) Int. Cl.

| | |
|---|---|
| ***A44C 5/18*** | (2006.01) |
| ***A44C 5/00*** | (2006.01) |
| ***A44C 5/20*** | (2006.01) |

(52) U.S. Cl.

CPC ..... *A44C 5/0084* (2013.01); *A44C 5/2047* (2013.01); *Y10T 24/45241* (2015.01); *Y10T 29/49595* (2015.01)

(58) Field of Classification Search

None

See application file for complete search history.

(56) References Cited

U.S. PATENT DOCUMENTS

| | | | | |
|---|---|---|---|---|
| 295,108 | A * | 3/1884 | Bugbee | 63/6 |
| D686,520 | S * | 7/2013 | Rafaelian | D11/5 |

* cited by examiner

*Primary Examiner* — Jack W Lavinder

(74) *Attorney, Agent, or Firm* — Michael J. Feigin, Esq.; Feigin & Fridman

(57) ABSTRACT

In an embodiment of the disclosed technology, a bracelet is generally formed of a circular wire band that is elastically deformable. That is, at least a portion of the band is bendable by a user such that the band returns to its original form when released by the user. The bracelet has a "clasp" portion, which is a hollow tubular member, affixed to one end of the band. Another end of the band forms a bend for retaining the end of the band inside the hollow tubular member. The hollow tubular member has a portal at one end for receiving the bend. The portion of the band near the bend is deflected slightly to enable passage through the portal of the bend. Upon passage through the portal, the bend releasably fastens the two ends of the band to one another.

9 Claims, 9 Drawing Sheets

SELF-ADJUSTABLE JEWELRY CLASP

FIELD OF THE DISCLOSED TECHNOLOGY

The disclosed technology relates generally to jewelry and, more specifically, to a clasp for a bracelet, necklace, anklet or the like.

BACKGROUND OF THE DISCLOSED TECHNOLOGY

Jewelry is popularly worn by individuals of all ages. Different types of jewelry have different fastening and clasping mechanisms. Circuitous pieces of jewelry, such as bracelets, necklaces, and anklets, are typically of a fixed length. Fasteners for these types of jewelry fix the jewelry at a certain length around a wearer's wrist, neck or ankle. Moreover, conventional tiny clasps make it difficult for individuals with arthritis or poor eyesight to put on jewelry.

Many improvements exist in the prior art for releasably clasping or fastening two ends of these types of jewelry. Magnetic clasps have been introduced for providing an easy-to-use clasp which reduces the risk of accidental breaking of the jewelry item. However, magnetic clasps and other types of fasteners determine its length. Moreover, magnetic clasps become unfastened with even minimal force. This could result in a piece of jewelry becoming accidentally removed and lost. On the other hand, if too much force is exerted on fixed fasteners, this may result in breaking of the clasp or a portion of the piece of jewelry.

Adjustable necklaces and bracelets have been introduced which allow the clasp to be fastened to any link along a length thereof. However, this results in an unsightly excess piece of chain hanging from where the clasp is fastened. Moreover, these types of jewelry are still susceptible to breaking if pulled on too strongly.

SUMMARY OF THE DISCLOSED TECHNOLOGY

Therefore, it is an object of the disclosed technology to provide a clasp for a jewelry band that is adjustable, easy-to-fasten and unbreakable.

As such, in an embodiment of the disclosed technology, a band forms a bracelet, the band having a first end and second end adapted to removably connect thereto. The first end terminates at a bent region (also referred to as a "bend"). "Bent region," for purposes of this disclosure, is defined as a an abrupt or rounded change in angle of at least 45 degrees, 60 degrees, 75 degrees, or 90 degrees (depending on embodiment) with respect to an otherwise generally circuitous band which resides in a single plane. That is, the bent region may form an L-shape, a hook, or an open-ended rectangle. "Generally" for purposes of this disclosure refers to what an ordinary observer or person of ordinary skill in the art would consider to be so. Thus, if a person of ordinary skill in the art would call a hook "bent", then it would, in this example, be considered bent.

The second end of the band terminates at a hollow tubular member, the hollow tubular member, forming an arc of a circle, the circle being defined by the shape of the band of the bracelet. An "arc" is defined as a closed segment of the circumference of a circle. An "arc" is identified by a corresponding subtended angle—the larger the degree of the angle, the longer the length of the arc. The angle subtended by the arc formed by the hollow tubular member may be between 30 degrees and 120 degrees. That is, the arc may account for between 1/12th and 1/3rd, inclusive, of the entire circumference of the circle formed by the band. In further embodiments, the subtended angle may be further restricted to a range between 30 and 60 degrees. A portal or slot gives access to the hollow region of the tubular member and extends along a majority of the arc of the circle formed by the tubular member. A second portal is disposed at an extreme end, the second end the band. The portal has a widest width less than that of the bent region of the first end.

In further embodiments of the bracelet, the bent region may extend in a direction substantially perpendicular (within 5 degrees of) to, or perpendicular to, the band. The extension may be less than the depth of the portal. Further, the widest width of the second portal may be greater than a diagonal length of the bent region, and the band may be bendable or malleable, meaning that it may be temporarily adjusted in shape, but returnable to the original shape, in the eyes of an ordinary observer. Still further, the first end of the band may be removable from the second end by bending the band and removing the bent region while bending the bent region towards the portal entering in the hollow region.

In still further embodiments of the bracelet, a decorative ornament may be disposed on the hollow tubular member. The ornament may form a portion of the hollow tubular member. Further, at least one charm may be slidably tethered to the band. In embodiments, the bent region may form a hook, a "hook" being defined as an elongated member terminating at a substantially rounded or curved head, the rounded head resulting in a substantially C-shaped configuration.

In another embodiment of the disclosed technology, a clasp is used for releasably fastening a first end and a second end of a band of a continuous piece of jewelry. "Continuous," for purposes of this specification, is defined as relating to a line or curve that extends without break. Thus, a "continuous piece of jewelry" is one that, in its clasped or fastened state, forms a circuit without a break. Thus, a necklace, bracelet, anklet are all examples of "continuous pieces of jewelry." The clasp is formed by an elongated member having a proximal and a distal end, with an elongated cavity there-between. "Proximal" is defined as the point of attachment of an appended member, in this case, the "proximal end" of the elongated member is the end that is affixed to the band. A "distal" end opposes the proximal end, and is defined as the point of an appended member that is furthest from the point of removable attachment and is fixably attached (designed to remain attached during ordinary usage by the wearer, including donning and removing the jewelry). A bend is formed at the termination of the first end of the band, the bend being adapted to be inserted into the cavity via a portal axially disposed on the distal end of the elongated member. The bend extends radially from the cavity through a radially disposed elongated slot on the elongated member.

In further embodiments of the clasp, the first end of the band is removable from the second end by deflecting the band and removing the bend while deflecting the bend towards the portal entering into the cavity. Still further, the bend may protrude radially past the slot such that the bend is slidably confined to the slot. The bend may form an angle with the band, the angle being between 30 degrees and 150 degrees.

In yet another embodiment of the disclosed technology, a method is used for clasping a continuous piece of jewelry having a first end terminating at a bent region and a second end terminating at a proximal end of a hollow tubular member. In an embodiment, the hollow tubular member may form an arc of a circle. The method is carried out, not necessarily in this order, by: a) deflecting a portion of the piece of jewelry, such that the bent region substantially points into an opposing portal on a distal end of the hollow tubular member; b) inserting the first end into the portal; and c) releasing the portion of the piece of jewelry such that the piece of jewelry returns to an undeflected state, whereby the bent region is slidably confined to a slot formed in a side of said tubular member. In further embodiments, the method may be continued by: d) deflecting the portion of the piece of jewelry such that the bent region becomes substantially parallel to the portal; e) removing the bent region through the portal; f) placing the piece of jewelry around a wrist of a user prior to the step of deflecting the portion of the piece of jewelry, such that upon the step of releasing, the piece of jewelry resides around the user's wrist; and/or g) adjusting a length of the piece of jewelry by sliding the bent region along the slot.

In embodiments, the bracelet and band are stiff. That is, they retain a generally circular shape. In other embodiments, the band is flexible and retains any shape in which it is left. With a flexible band, the "circular shape" is one in which a perfect circle, or the closest approximation reasonably possible, is made out of the flexible band. The bracelet may instead be malleable (flexible, but returning to its general shape and retaining such shape during ordinary usage thereof). The bent region or hook is rigid, but the rest of the bracelet may be flexible or bendable.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

In an embodiment of the disclosed technology, a bracelet is generally formed of a circular band that is elastically deformable. The band may be formed of plastic, metal or any other elastically deformable material. "Elastically deformable," for purposes of this specification, means a material that returns to its original form after being bent or otherwise deflected. Thus, the band has spring-like properties in that it retains its original, circuitous shape after being bent. That is, a portion of the wire band is bendable by a user, such that the band returns to its original form when released by the user. The bracelet has a "clasp" portion, which is a hollow tubular member, affixed to one end of the band. Another end of the band forms a bent region, bend or hook for retaining the end of the band inside the hollow tubular member. The hollow tubular member has a portal at one end for receiving the bent region. The portion of the band near the bend is deflected slightly to enable passage through the portal of the bend. Upon passage through the portal, the bend releasably fastens the two ends of the band to one another.

Embodiments of the disclosed technology will become clearer in view of the following description of the drawings.

Figure 1:
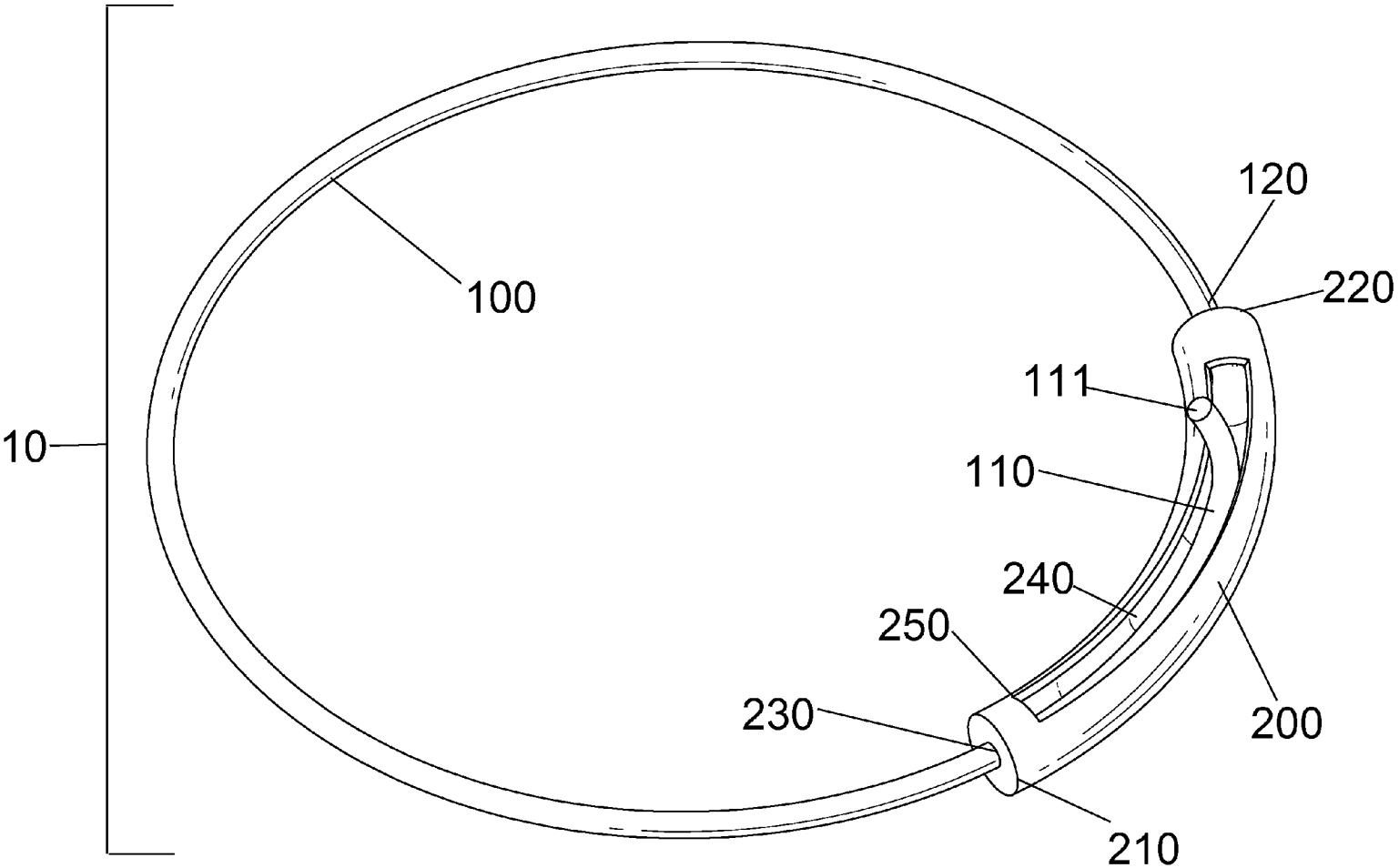
FIG. 1 shows a top perspective view of a closed bracelet of an embodiment of the disclosed technology.

FIG. 1 shows a perspective view of a closed bracelet of an embodiment of the disclosed technology. The bracelet 10 is generally circular, being formed by a band 100 and a clasp 200 formed by a hollow tubular member. While an exemplary "bracelet" is used in this specification describing the disclosed piece of jewelry, the term should not be considered limiting. Thus, any continuous piece of jewelry may employ the disclosed technology—that is, any piece of jewelry which generally requires two ends to be fastened to one another in order to apply the jewelry to an individual. Thus, "bracelet," when used in this disclosure, may also interchangably refer to a necklace, an anklet, a choker, a hoop earring, and so forth. "Generally," for purposes of this disclosure, is defined as "what an ordinary observer would consider as such" or "at least 75% being as such." Thus, when the bracelet 10 is called "generally circular," even though it may have a clasp and a band that do not form a complete circuit, the bracelet is still considered generally circular. Furthermore, even if the bracelet forms a polygonal shape, such as an octagon, it is still considered "generally circular," in that it is continuous or circuitous when it is in a closed or fastened position. The band 100 forms a majority of the perimeter of the circle where "majority," for purposes of this disclosure, is defined as "at least 75% of the perimeter."

A first end 110 of the band 100 forms an elastically deformable region having a bend, bent region or hook (hereinafter referred to as "bend 111") at an extremity thereof. While the whole band 100 may be homogeneous in that it is elastically deformable, the first end 110 is considered the deformable or bendable region, because that is the portion of the band that is deformed by a user to apply and/or remove the bracelet. The first end 110 is proximal to the bent region 111 and extends to no greater than 25% of the arc or length of the band 100.

A second end 120 of the band 100 is affixed to a proximal end 220 of the hollow tubular member or clasp (herein "clasp 200"). The clasp 200 is generally elongated. The clasp 200 is also generally hollow, having a cavity 240, where "generally hollow," for purposes of this disclosure, is defined as having an elongated hollow core that has a cross-section which, at its narrowest, is wider than the bend 111 and/or the first end 110 of the band 100. A distal end 210 (fixedly or non-removably attached to the band 100) of the clasp 200 has a horizontally disposed portal 230 disposed thereon. The portal 230 opens to the interior cavity 240 of the clasp 200. The cavity 240 runs along the interior of a majority of the length of the clasp 200, terminating at or near the proximal end 220 of the clasp. That is, in an embodiment, a solid and fixed connection exists at the proximal end 220, where a fixed connection point exists with the second end of band 120.

An elongated slot 250 runs along a majority or between 80% and 99% of the length of the clasp 200, opening along a majority of the length of the slot itself, as well as at one extreme end, at the portal 210. The slot 250 provides access into the cavity 240 of the clasp 200. When inserted into the portal 230, a portion of the bend 111 protrudes into the slot 250, such that the slot slidingly confines the movement of the bend and prevents the first end 110 from becoming removed from the clasp 200. Thus, when the bracelet 10 is pulled apart (i.e., the first end 110 is pulled in a direction out from the portal 230), the radially extending region of the bend 111 catches on the edge of the slot 250 to prevent the first end 110 from being removed from the clasp 200. The slot 250 also permits the length of the bracelet 10 be adjustable when the bracelet is donned. The bend 111 is slidable within the slot 250 such that the bracelet 10 conforms to a wrist of a user when donned. Thus, if the wrist of the user is relatively wide, the bracelet 10 may be expanded until the bend 111 abuts the edge of the slot 250, thereby resulting in the bracelet being in its longest closed form. Thus, if the bracelet 10, in its undeformed state, has a six inch circumference, the length of the bracelet may be adjusted by, for example, a half inch in each direction. In this example, if the clasp 200 is one inch long, the circumference of the bracelet may theoretically be adjusted between five and a half inches and six and a half inches. The possibility to lengthen or shorten the bracelet will depend on where the bend 111 resides within the slot 250 in the closed position. The "closed position" refers to the fastened state of the bracelet 10 that is achieved when the bend 111 has been inserted through the portal 210. The aforementioned example implies that the bend 111, in the resting state, extends approximately halfway through the clasp 200—the "resting state" being when the bracelet is released such that no forces are acting on it, thus returning to its undeflected, original form. Referring back to FIG. 1, the bend 111 is shown extending about 80% of the way into the clasp 200. As such, any resting configuration of the bend 111 within the slot 250 is possible.

Figure 2:
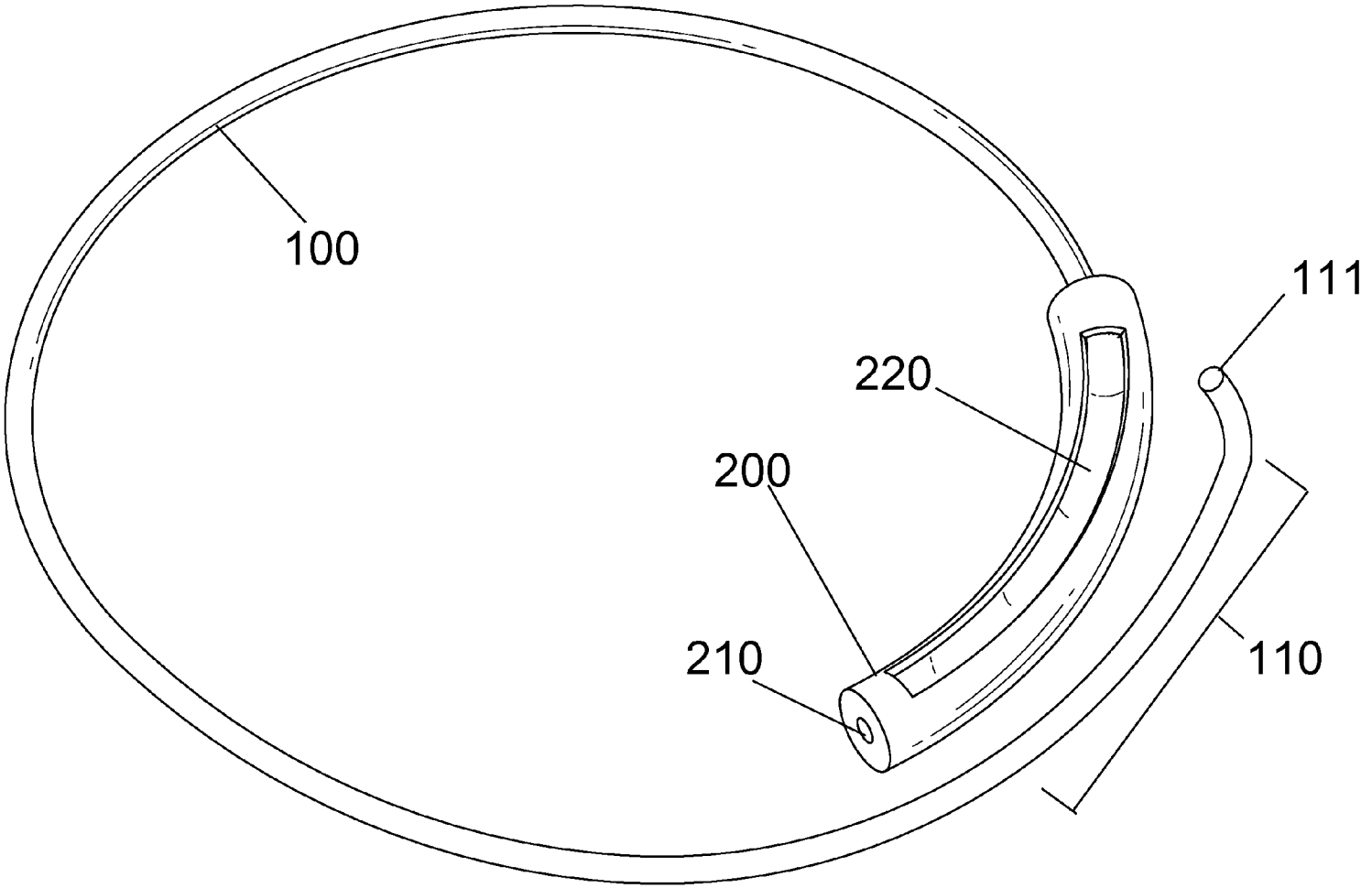
FIG. 2 shows a top perspective view of an open bracelet of an embodiment of the disclosed technology.

FIG. 2 shows a top perspective view of an open bracelet of an embodiment of the disclosed technology. In this figure, the first end 110 and the bend 111 are outside of the clasp 200. In a resting, open state, the band 100 generally retains a circular form, in an embodiment of the disclosed technology. When wearing the band is desired, the first end 110 (proximal portion of the band 100, being proximal to the bend 111) is deformed or bent by a user, such that the extreme end of the bend 111 is aligned with and facing the portal 210. As such, the bend 111 is inserted into the portal 210. Given the curvature of the bend 111, insertion is not possible without first bending the first end 110 to point the bend towards the portal 210 causing the bend 111 to be diagonal (turned between 45 and 90 degrees) from it's original orientation. In applying the bracelet 10, the band 100 is elastically deformable, such that it may be expanded horizontally and/or vertically to accommodate a wrist of a user.

Figure 3:
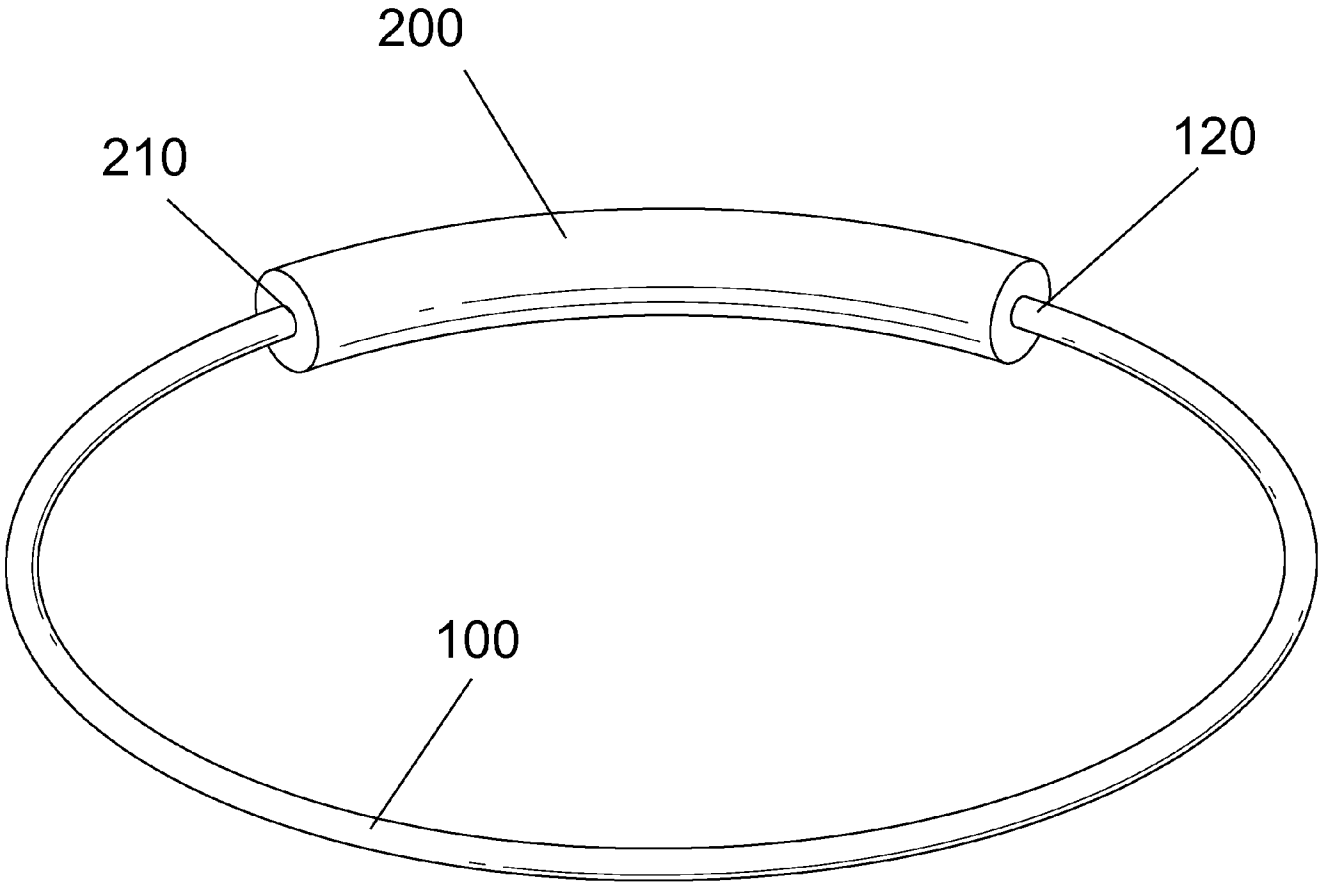
FIG. 3 shows a bottom perspective view of a closed bracelet of an embodiment of the disclosed technology.

FIG. 3 shows a bottom perspective view of a closed bracelet of an embodiment of the disclosed technology. From this view, the bracelet 10 appears to be uni-bodied, forming a single, continuous circle. Aesthetically, no fastening mechanism is visible, thus giving the bracelet 10 a symmetrical, minimalistic appearance.

Figure 4:
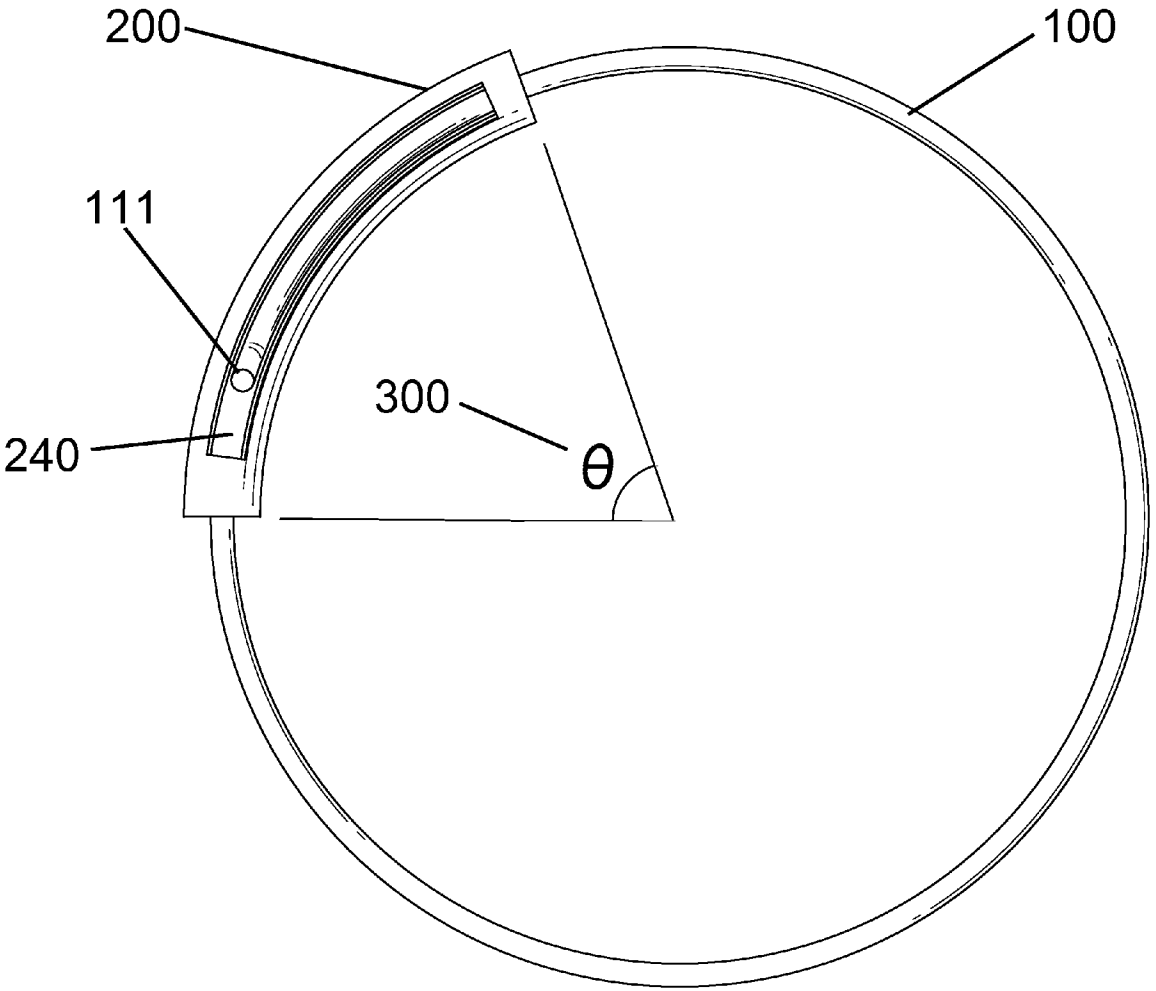
FIG. 4 shows a bottom plan view of a closed bracelet of an embodiment of the disclosed technology.

FIG. 4 shows a bottom plan view of a closed bracelet of an embodiment of the disclosed technology. θ [angle theta] 300 is indicative of the angle subtending or corresponding to an arc formed by the clasp 200 with respect to the band 100 and the rest of the bracelet 10. θ 300 may be any angle between 10 degrees and 180 degrees. Thus, the angle may be, for example, 10°, 20°, 30°, 40°, 45°, 50°, 60°, 75° and so forth. The size of θ 300 is correlative to the adjustability of the length of the bracelet. The larger the angle θ 300 is, the longer the arc formed by the clasp 200 will be, thereby giving a greater degree of adjustability. Regardless of the length of the clasp 200, the clasp 200 is greater than the length of the cavity 240, in view of the fact that the cavity only opens to one end of the hollow tubular member.

Figure 5:
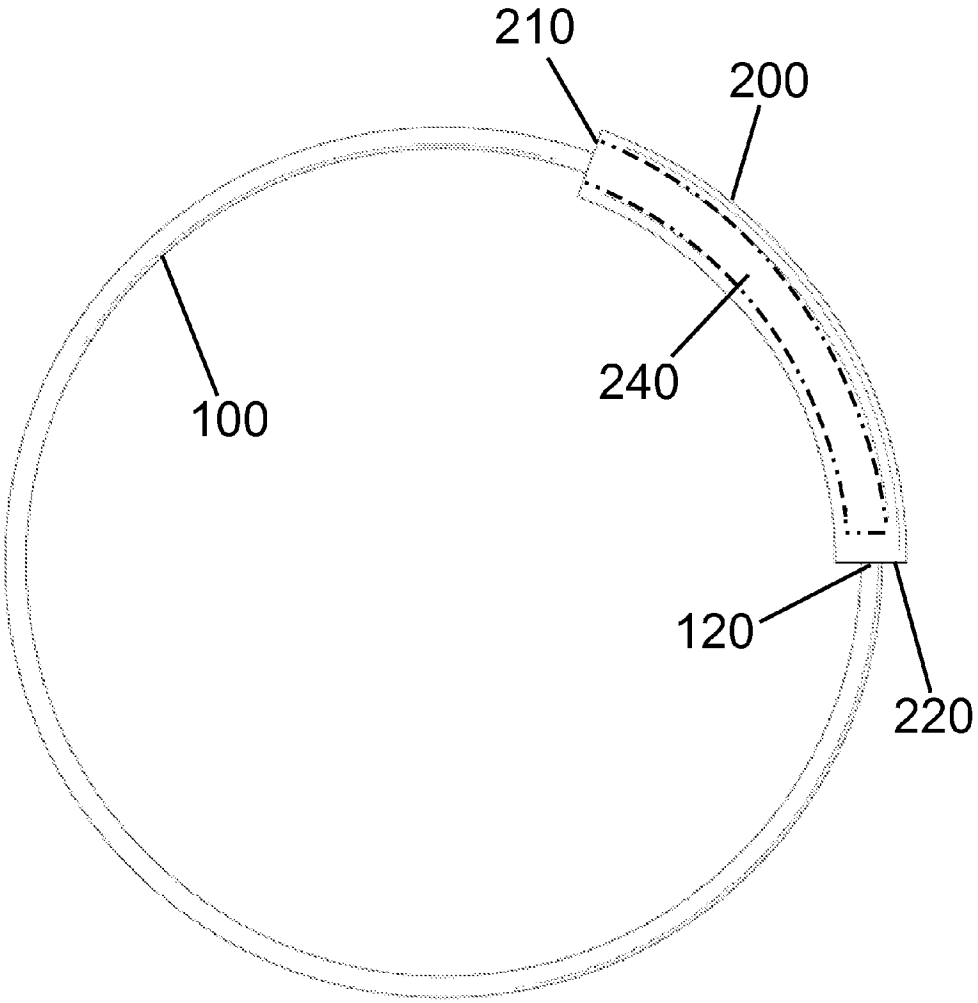
FIG. 5 shows a top plan view of a closed bracelet of an embodiment of the disclosed technology.

FIG. 5 shows a top plan schematic view of a closed bracelet of an embodiment of the disclosed technology. The dotted lines show the outline of the cavity 240 within the interior of the tubular clasp 240. The cavity 240 may also be tubular and sized to hold there-in the bend 111 and the first end 110 of the band 100. From the outline of the cavity 240, one can see that at the distal end 210 of the clasp 240, in this embodiment, the cavity extends all the way through the portal 210. At the proximal end 220 of the clasp 200, the cavity 240 terminates at a closed end, in embodiments. In an alternative embodiment, two different hooked or bent ends may attach into opposite portals. An ornament (not shown) may adorn the outer diameter of the clasp 200. The ornament may hug the curved outer contour of the clasp 200, and may hide the clasp from ordinary view, when viewed from above. Alternatively, the ornament may form the clasp itself. Additionally, charms (not shown) may be hung or tethered to the band 100 of the bracelet 10. The charms may employ an eye-hole or ring which may be slidingly placed around the band 100.

Figure 6:
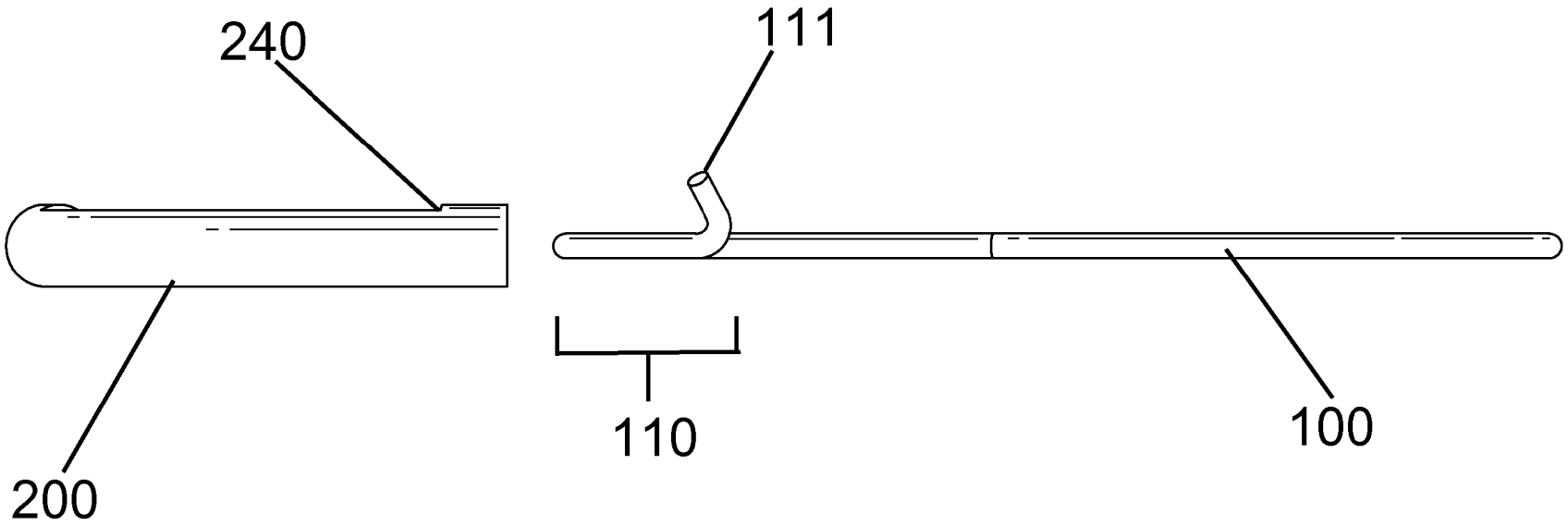
FIG. 6 shows an exploded side view of a bracelet of an embodiment of the disclosed technology.

FIG. 6 shows an exploded view of a bracelet of an embodiment of the disclosed technology. The band 100 is shown, separate from the clasp 200. The band 100 may generally reside in a single plane, with the exception of the protruding bend 111. The bend 111 may take different shapes and sizes. For example, the bend 111 may form an L-shape, a C-shape or a hook. The bend 111 may be extended outside or remain inside of the cavity 240 when the bracelet in closed. Similarly, the cavity 240 may form a single hole, in which case it may not be elongated. In such an embodiment, the bracelet 10 is not adjustable. The band 100 may form a complete circle, with a break along a circumference thereof for the bend 111.

Figure 7:
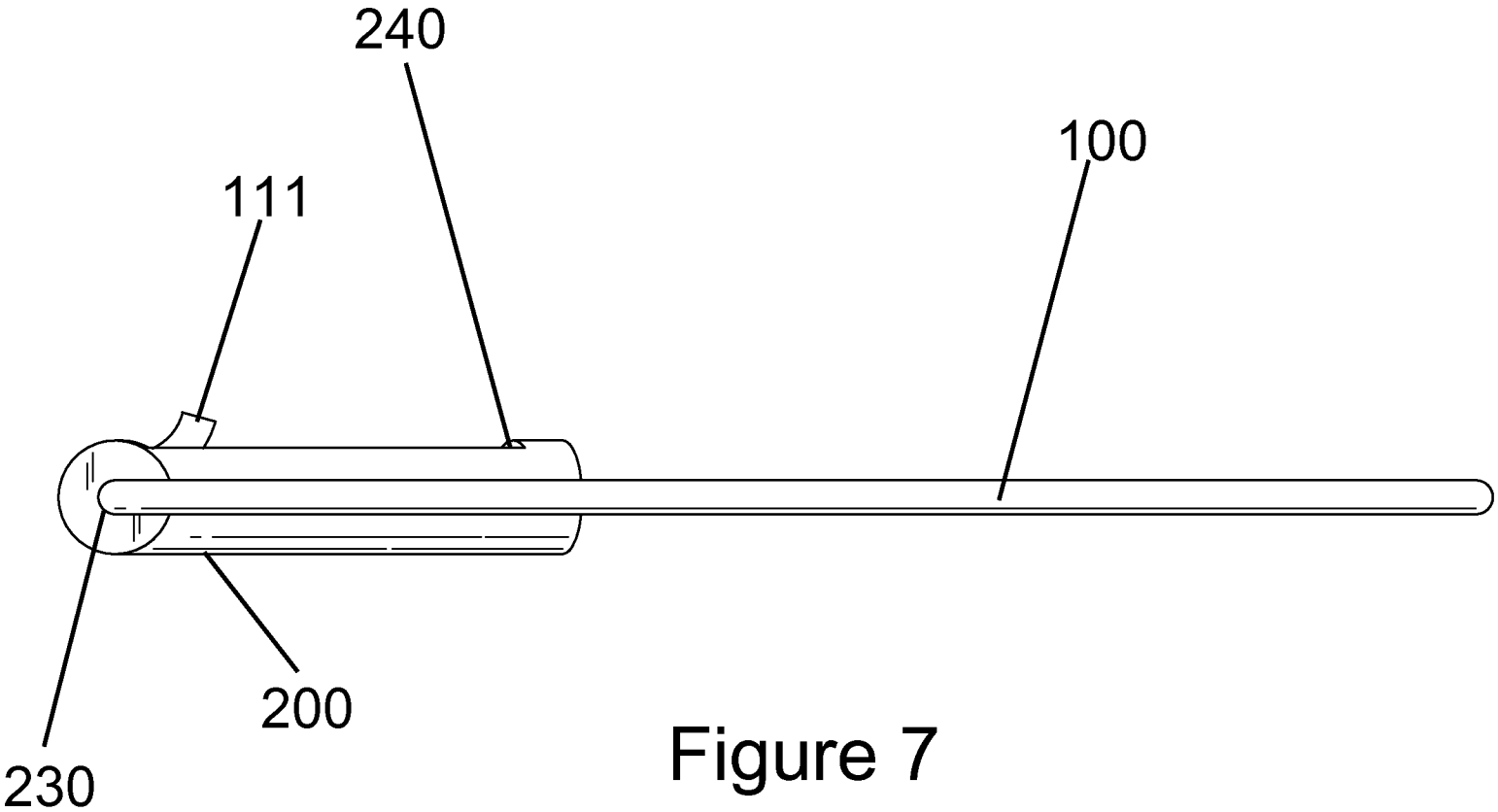
FIG. 7 shows a side view of a bracelet of an embodiment of the disclosed technology.

FIG. 7 shows a side view of a closed bracelet of an embodiment of the disclosed technology. In the embodiment shown, the bend 111 is long enough so that it protrudes out of the cavity 240. In another embodiment, the bend 111 remains entirely within the cavity 240. By angling the attachment end of the bracelet, and, therefore, also the bend, the bend may exit from the portal. As discussed, when pulled, the radially extended region of the bend 111 catches on the edge of the cavity on the distal side of the clasp 200, preventing the bracelet 10 from opening or becoming undone.

Figure 8:
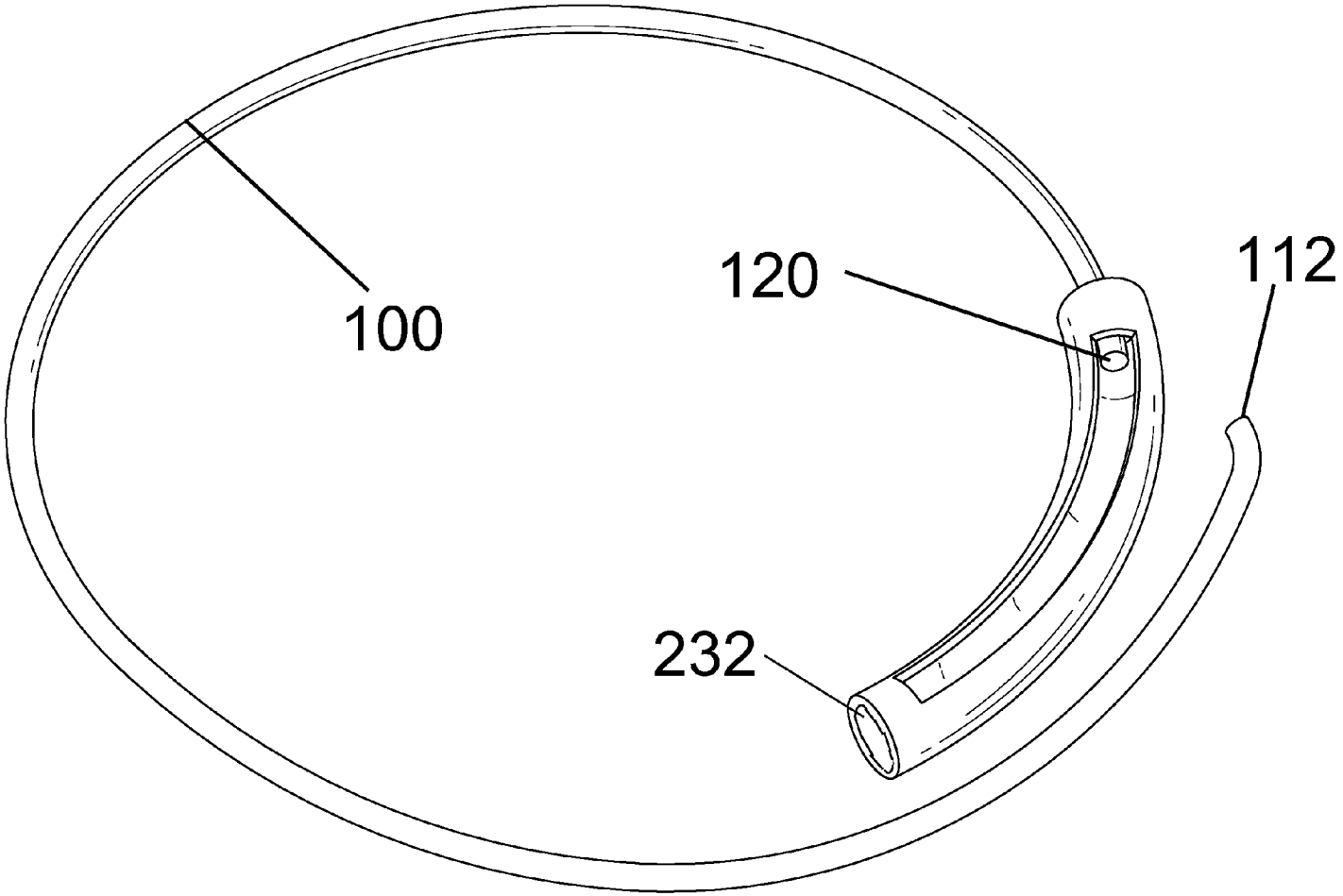
FIG. 8 shows a top perspective view of an open bracelet of another embodiment of the disclosed technology.

FIG. 8 shows a top perspective view of an open bracelet of another embodiment of the disclosed technology. In the embodiment shown, the bend 112 forms an approximately 60° elbow shape. As discussed, the bend 112 of FIG. 8 is but one of many shape configurations of the bend on the first end 110 of the band 100. Also apparent in FIG. 8 is the second end 120 of the band 100 extending into the cavity 240 of the clasp. In this configuration, the second end 120 of the band 100 may be fixed inside the clasp 200 to increase strength and durability of the bond. The portal 232 of FIG. 8 has a larger diameter than that of the bracelet shown in FIG. 2. The portal 232 may vary in size and shape, depending on the size and shape of the bend 112 and the first end 110.

Figure 9:
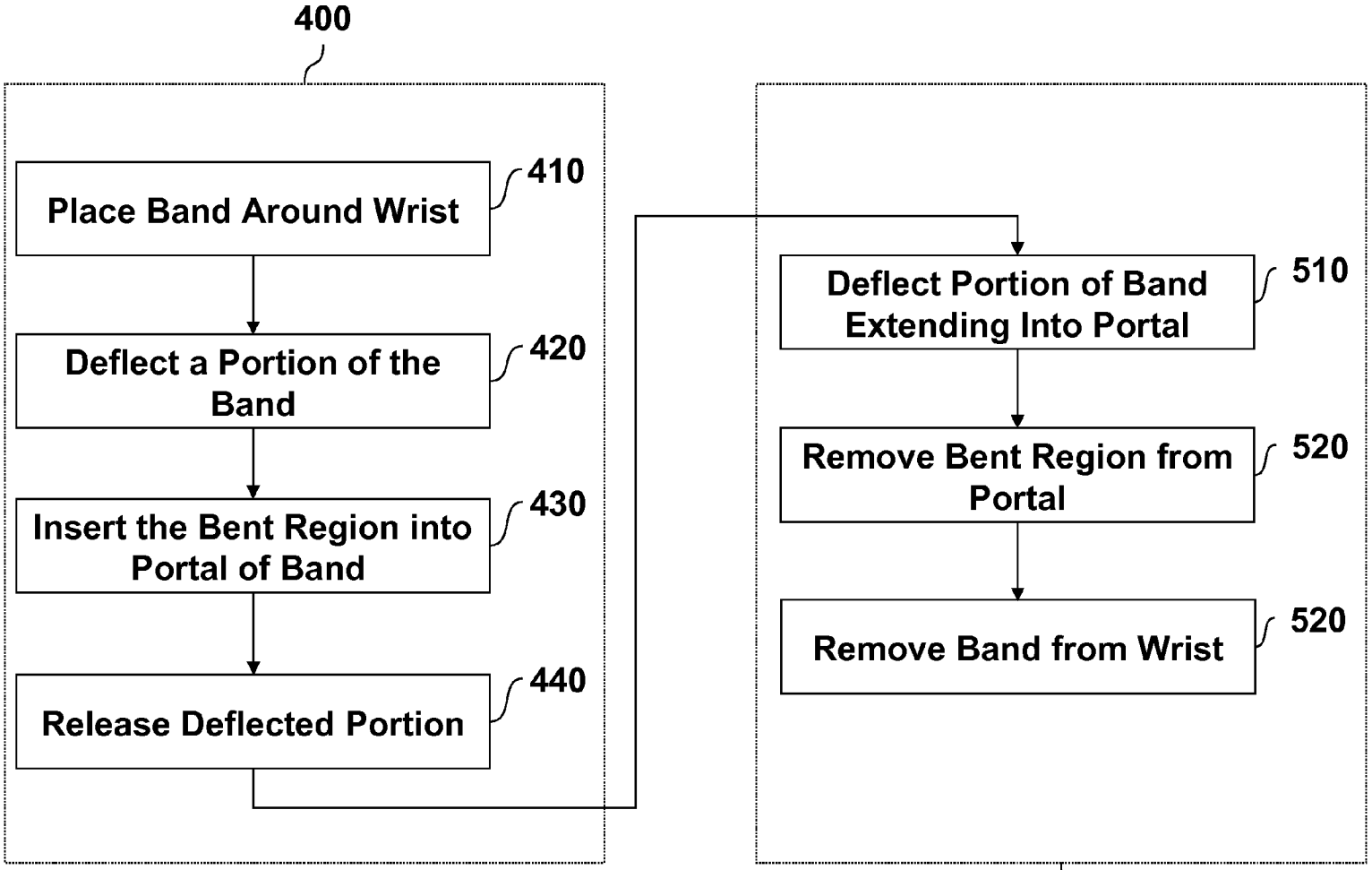
FIG. 9 shows a flow chart illustrating the steps of a method of carrying out an embodiment of the disclosed technology.

FIG. 9 shows a flow chart illustrating the steps of a method of carrying out an embodiment of the disclosed technology. The method of FIG. 9 is divided into two parts. The first phase of the method is the application phase 400, during which a user applies the bracelet. The second phase is the removal phase 500, during which the user removes the bracelet.

The application phase 400 begins with step 410, whereby the band is placed around the wrist of a user. It should be noted that charms, beads or other decorative elements may optionally be fed onto the band before step 410. In placing the band around the wrist, the band may be deflected, bent, pulled-apart or otherwise temporarily altered in order to accommodate the wrist of the user. In step 420, a portion of the band is deflected such that the bend is substantially parallel to the portal of the tubular member. Next, the bend is inserted into the portal in step 430. The configuration of the bracelet is such that the bend may only fit into the portal if the radially extending region of the bend is oriented such that it is co-axial or nearly co-axial with the portal. In step 440, the user releases the deflected portion, whereby the band returns to its original form. At this instance, the bend is confined to the slot of the tubular member such that the bracelet cannot be removed by simply pulling on the band. Further, depending on the size of the user's wrist, the bend may be slidably moved within the slot such that the length of the bracelet is adjusted. When the bend is slid towards the distal end of the clasp, the bracelet is lengthened. Conversely, when the bend is slid towards the proximal end of the clasp, the bracelet is shortened. While the band may substantially retain its general form, the band may be biased by a user with a small wrist relative to the size of the band, such that the bracelet is shortened. Similarly, when adorned by a user with a larger wrist, the band may be caused to expand by the girth of the wrist. The application phase 400 is ended, and the bracelet is properly donned on the wrist of the user.

The removal phase 500 is initiated by a user when he or she desires to remove the bracelet. Step 510 involves deflecting a portion of the band again. The band may be deflected in the same manner as in steps 410 and/or 420. However, the band is configured such that it may be applied, fastened, unfastened, and removed in any number of ways. That is, the bracelet is versatile in that the band may be bent, twisted, or otherwise deformed in any manner. Next, in step 520, the bent region is removed from the portal. Finally, in step 530, the bracelet is removed from the user's wrist. Again, the band may be deflected, bent, pulled-apart or otherwise temporarily altered in order to be removed from the wrist.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

I claim:

1. A clasp for releasably fastening a first end and a second end of a band of a continuous piece of jewelry, said clasp comprising:

an elongated member having a proximal and a distal end with an elongated cavity defined axially there-between, said proximal end of said elongated member affixed to said second end of said band; and a bend formed at a termination of said first end of said band, said bend adapted to be inserted into said cavity via a portal axially disposed on said distal end of said elongated member, said bend extending radially from said cavity through a radially disposed elongated slot on said elongated member.

2. The clasp of claim 1, wherein said first end of said band is removable from said second end by deflecting said band and removing said bend while deflecting said bend towards said portal entering into said cavity.

3. The clasp of claim 1, wherein said bend protrudes radially past said slot such that said bend is slidably confined to said slot.

4. The clasp of claim 1, wherein said bend forms an angle with said band, said angle being between 30 degrees and 150 degrees.

5. A method of clasping a continuous piece of jewelry having a first end terminating at a bent region and a second end terminating at a proximal end of a hollow tubular member, said method comprising:

deflecting a portion of said piece of jewelry such that said bent region substantially points into an opposing portal on a distal end of said hollow tubular member;

inserting said first end into said portal; and releasing said portion of said piece of jewelry such that said piece of jewelry returns to an undeflected state, whereby said bent region is slidably confined to a slot formed in a side of said tubular member.

6. The method of claim 5, wherein said hollow tubular member forms an arc of a circle.

7. The method of claim 5, further comprising an additional step of:

deflecting said portion of said piece of jewelry such that said bent region becomes substantially parallel to said portal; and removing said bent region through said portal.

8. The method of claim 5, further comprising a step of:

placing said piece of jewelry around a wrist of a user prior to said step of deflecting said portion of said piece of jewelry, such that upon said step of releasing, said piece of jewelry resides around said wrist of said user.

9. The method of claim 5, further comprising a step of:

adjusting a length of a said piece of jewelry by sliding said bent region along said slot.

* * * * *